US008281528B2

(12) United States Patent
Clarke

(10) Patent No.: US 8,281,528 B2
(45) Date of Patent: Oct. 9, 2012

(54) APPARATUS FOR SECURING WALL MEMBERS FOR LOG HOMES

(75) Inventor: Gregory A. Clarke, London (CA)

(73) Assignee: Pointblank Design Inc., London, Ontario (CA)

( * ) Notice: Subject to any disclaimer, the term of this patent is extended or adjusted under 35 U.S.C. 154(b) by 247 days.

(21) Appl. No.: 12/750,134

(22) Filed: Mar. 30, 2010

(65) Prior Publication Data

US 2011/0239565 A1 Oct. 6, 2011

(51) Int. Cl.
*E04B 1/10* (2006.01)
*E04B 1/38* (2006.01)
*E04B 2/02* (2006.01)

(52) U.S. Cl. ..... 52/223.7; 52/223.14; 52/233; 52/573.1

(58) Field of Classification Search ..... 52/223.5, 52/223.7, 223.14, 233, 291, 573.1, 295
See application file for complete search history.

(56) References Cited

U.S. PATENT DOCUMENTS

| | | | | |
|---|---|---|---|---|
| 3,341,905 | A * | 9/1967 | Gill | 24/105 |
| 3,854,371 | A * | 12/1974 | Lamothe | 411/337 |
| 4,503,647 | A | 3/1985 | Post | |
| 4,688,362 | A * | 8/1987 | Pedersen et al. | 52/223.7 |
| 4,823,528 | A * | 4/1989 | Faw | 52/233 |
| 4,909,012 | A * | 3/1990 | Thompson et al. | 52/745.21 |
| 5,081,811 | A | 1/1992 | Sasaki | |
| 5,392,573 | A * | 2/1995 | Gould | 52/165 |
| 5,535,561 | A * | 7/1996 | Schuyler | 52/223.13 |
| 5,890,332 | A * | 4/1999 | Skidmore et al. | 52/271 |
| 6,347,916 | B1 * | 2/2002 | Ramirez | 411/372.5 |
| 6,758,020 | B2 * | 7/2004 | Cerrato | 52/606 |
| 6,904,728 | B2 * | 6/2005 | Stutts | 52/233 |
| 7,117,647 | B2 * | 10/2006 | Clarke | 52/233 |
| 7,520,102 | B1 * | 4/2009 | diGirolamo et al. | 52/741.13 |
| 7,735,272 | B2 * | 6/2010 | Caroussos | 52/233 |
| 8,061,095 | B2 * | 11/2011 | Bucheger | 52/223.7 |
| 2004/0020145 | A1 * | 2/2004 | Matsufuji | 52/223.7 |
| 2005/0252118 | A1 * | 11/2005 | Matsufuji | 52/223.7 |
| 2006/0016140 | A1 * | 1/2006 | Smith | 52/295 |
| 2006/0248825 | A1 * | 11/2006 | Garringer | 52/233 |
| 2006/0288656 | A1 * | 12/2006 | Clarke | 52/233 |
| 2009/0133345 | A1 * | 5/2009 | Wrightman | 52/233 |
| 2011/0030299 | A1 * | 2/2011 | Raynor | 52/295 |

OTHER PUBLICATIONS

"The New Log Lock Compression System p. 1" from web site, http://www.truenorthloghomes.com/images/why/improvements-loglocks-01-big.jpg, printed Nov. 10, 2009.
"The New Log Lock Compression System p. 2" from web site, http://www.truenorthloghomes.com/images/why/improvements-loglocks-02-big.jpg, printed Nov. 10, 2009.
"True North Log Homes—ThermoGroove6Seal.pdf" from web site http://www.truenorthloghomes.com, date unknown.

* cited by examiner

*Primary Examiner* — Robert Canfield
(74) *Attorney, Agent, or Firm* — Bereskin & Parr LLP/S.E.N.C.R.L., s.r.l.

(57) ABSTRACT

An apparatus for securing a plurality of wall members together to define a wall. The apparatus includes a base portion having a stud extending upwardly therefrom, the base portion configured to engage a surface of a first wall member. The apparatus also includes a first securing member sized and shaped to engage with a surface of a second wall member stacked above the first wall member. The apparatus also includes a first coupling member configured to extend through a bore in the first and second wall members. The first coupling member has an elongate rod member having an upper end and a lower end, and a coupler on the lower end of the rod member, the coupler being sized and shaped to receive the stud member therein. The upper end of the rod member is configured to be coupled to the first securing member for biasing the first and second wall members together to inhibit the formation of undesired spaces therebetween.

23 Claims, 4 Drawing Sheets

APPARATUS FOR SECURING WALL MEMBERS FOR LOG HOMES

TECHNICAL FIELD

The embodiments described herein relate to timber structures, and more particularly to apparatus for securing wall members for log homes and other timber structures.

INTRODUCTION

Structures such as log homes commonly have walls made of a plurality of logs or timber members stacked one above the other to provide a vertically extending wall.

The timber wall members may be of various shapes and sizes, and in some cases may be rough hewn or machined to have specific profiles. When rough-hewn, adjacent timber members may be sealed together by chinking or caulking along the length of the timber members to provide a seal that inhibits water and air from passing between adjacent timber members.

With machined timbers, surface features such as interengaging tongues and grooves may be provided on complementary upper and lower surfaces of the timbers to help secure them together. Furthermore, sealing members such as asphalt, foam or other seals may also be provided between the timbers to help provide air and water-tightness.

During fabrication of a timber wall, it is common for the timber members to include significant amounts of moisture therein (e.g. the timber members may be "green" logs). As the timber members dry, they tend to shrink across the direction of the grain, which leads to an overall reduction of the size of the timbers.

In most cases there will be a difference in the shrinkage rates between different timber members in a wall, and even along the length of the same timber member. This is problematic, as it can create spaces or gaps between adjacent timber members that allow air or water to pass through the wall, which is undesirable. This may be further aggravated by settling of the timber members.

One approach to help provide good sealing between the timbers is to insert a vertical threaded rod through the timbers from the top to the bottom of the wall. For example, U.S. Pat. No. 4,503,647 to Post describes a tie rod extending in a vertical direction through bores of support members in a timber structure. Each tie rod may consist of a steel rod that is provided with threaded portions on its tie rod ends. Nuts may be threaded onto these threaded portions, with washers disposed beneath the nuts.

Various improvements to this basic technique have also been developed. For example, U.S. Pat. No. 6,904,728 to Stutts describes a wall that includes a plurality of wall members stacked substantially vertically and including a bottom wall member and a top wall member. A through opening in the wall extends from the upper surface of the top wall member to the lower surface of the bottom wall member. A rod is positioned in the through opening of the wall and a lower fastener comprising a locking nut with an internally threaded portion attaches to the lower end of the rod adjacent the lower surface of the bottom wall member. An upper fastener attaches to the upper end of the rod adjacent the upper surface of the top wall member. An actuator (e.g. including a spring) is positioned between the upper fastener and the upper surface of the top wall member for applying a downward force to the top wall member.

However, one problem with the use of tie rods, including the Stutts approach, is that wood chips and other particulates tend to become caught in the threads of the rod and the internally threaded lower fastener. This can interfere with coupling between the rod and the fasteners.

A proposed solution is described in U.S. Patent Application Publication No. 2009/0133345 to Wrightman. Wrightman describes a tie bolt assembly for a log building having a coil spring that applies a continuous compressive load to force the logs together. A chip deflector is located in a hole adjacent a bottom fastening, with the tie bolt passing through the chip deflector. Fingers on the chip deflector act to remove any debris from the surface of the tie bolt, such as wood chips that might remain in the hole after drilling, and which might impede the operation of the bottom fastening.

However, if the build up of debris is sufficient, or if the debris is moist, or both, the fingers will tend not to wipe the outer surface of the threads, and may in fact become lodged in the threads, impeding the coupling of the threaded rod and internally threaded lower fastener.

Accordingly, there remains need for improved apparatus for securing timber wall members together in log homes and other similar structures.

SUMMARY

According to one aspect of the invention, there is provided an apparatus for securing a plurality of wall members together to define a wall, the apparatus comprising: a base portion having a stud extending upwardly therefrom, the base portion configured to engage a surface of a first wall member; a first securing member sized and shaped to engage with a surface of a second wall member stacked above the first wall member; and a first coupling member configured to extend through a bore in the first and second wall members, the first coupling member having: an elongate rod member having an upper end and a lower end; and a coupler on the lower end of the rod member, the coupler being sized and shaped to receive the stud therein to couple the stud to the rod member; and wherein the upper end of the rod member is configured to be coupled to the first securing member for biasing the first and second wall members together to inhibit the formation of undesired spaces therebetween.

The stud may have an externally-threaded portion, and the coupler may have an internally threaded portion configured to engage with the externally-threaded portion of the stud as the stud is received within the coupler.

The apparatus may further comprise a sleeve member sized and shaped to cover at least a portion of the externally-threaded portion of the stud member. The sleeve member may be sized and shaped so as to be pushed down the stud as the stud is received in the coupler.

The apparatus may further comprise a second securing member sized and shaped to engage with a surface of a third wall member, and a second coupling member having a second coupler sized and shaped to receive the upper end of the rod member therein. The upper end of the rod member may be externally threaded, and the second coupler may have an internally threaded portion configured to engage with the external threads of the upper end of the rod member.

The first securing member may include a spring member sized and shaped to accommodate expansion and contraction of the first and second wall members.

The second wall member may have a bore with a first diameter, and the securing member may include an engaging member larger than the bore, the engaging member shaped to engage against the surface of the second wall member.

The plurality of wall members may include at least one timber member.

The apparatus may further comprise at least one protection member sized and shaped to be received in the at least one bore.

According to another aspect, there is provided a wall comprising: a first wall member; a second wall member stacked above the first wall member; and an apparatus for securing the wall members together, the apparatus comprising: a base portion having a stud extending upwardly therefrom, the base portion configured to engage a surface of the first wall member; a first securing member sized and shaped to engage with a surface of the second wall member; and a first coupling member configured to extend through a bore in the first and second wall members, the first coupling member having: an elongate rod member having an upper end and a lower end; and a coupler on the lower end of the rod member, the coupler being sized and shaped to receive the stud member therein; and wherein the upper end of the rod member is configured to be coupled to the first securing member for biasing the first and second wall members together to inhibit the formation of spaces therebetween.

The apparatus may further comprise a third wall member stacked above the second wall member, and wherein the apparatus further comprises a second securing member sized and shaped to engage with a surface of the third wall member, and a second coupling member having a second coupler sized and shaped to receive the upper end of the rod member therein.

According to yet another aspect, there is provided a wall, comprising: a first wall member; a second wall member stacked above the first wall member; a third wall member stacked above the second wall member; and an apparatus for securing the wall members together, comprising: a base portion configured to engage a surface of the first wall member; a first securing member provided within the wall and being sized and shaped to engage with a surface of the second wall member; a first coupling member configured to extend through a bore in the first and second wall members to couple the base portion to the first securing member; a second securing member sized and shaped to engage with a surface of the third wall member; and a second coupling member configured to extend through a bore in the third wall member to couple the first coupling member to the second securing member.

Other aspects and features of the invention will become apparent, to those ordinarily skilled in the art, upon review of the following description of some exemplary embodiments.

BRIEF DESCRIPTION OF THE DRAWINGS

The embodiments herein will now be described, by way of example only, with reference to the following drawings, in which.

DETAILED DESCRIPTION

Referring now to FIGS. 1 to 4 generally, illustrated therein is an apparatus 10 for securing wall members together for log homes and other timber structures.

Figure 1:
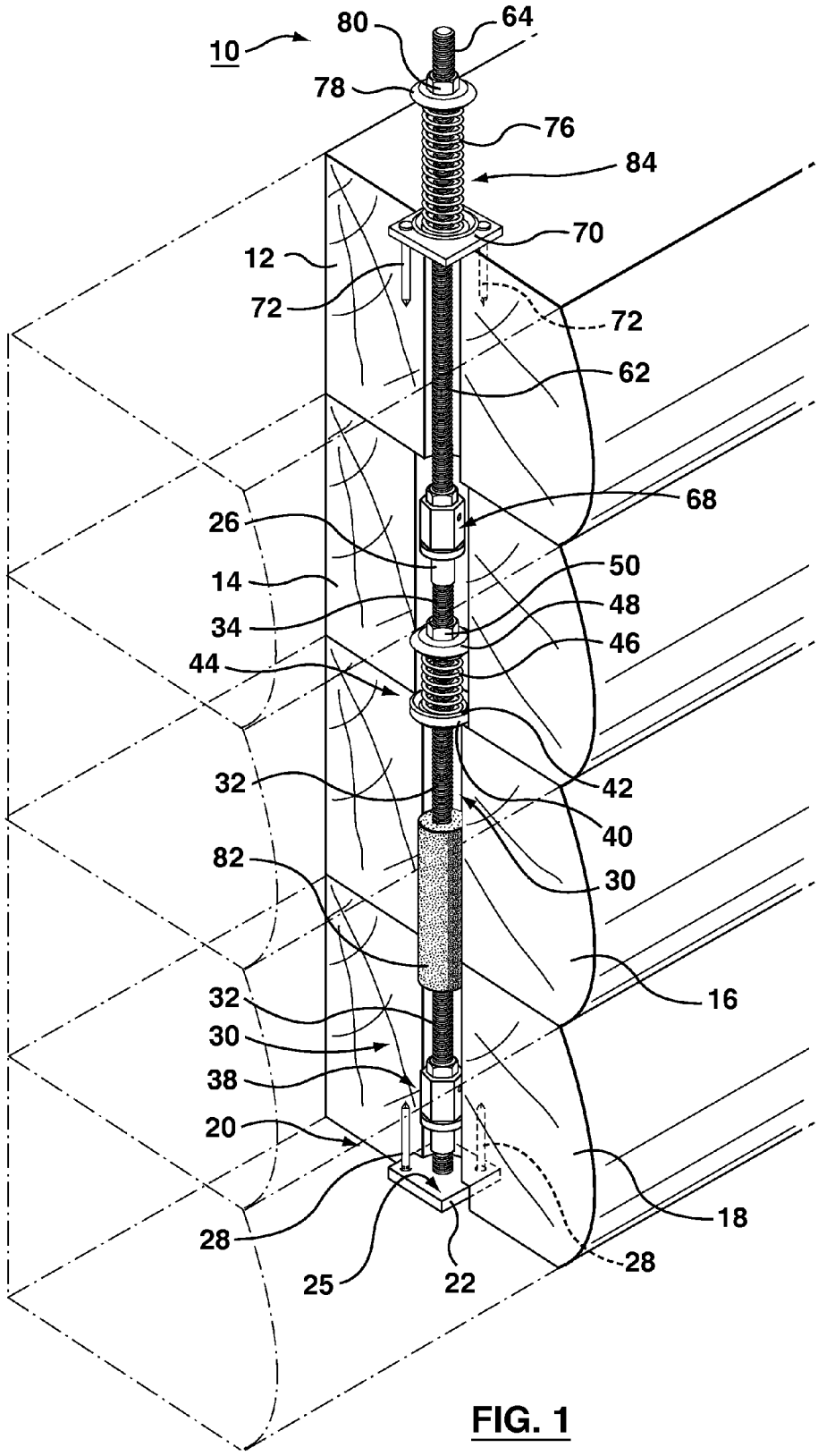
FIG. 1 is a perspective view of an apparatus for securing wall members together to form a wall for a log home or other timber structure according to one embodiment.
Figure 2:
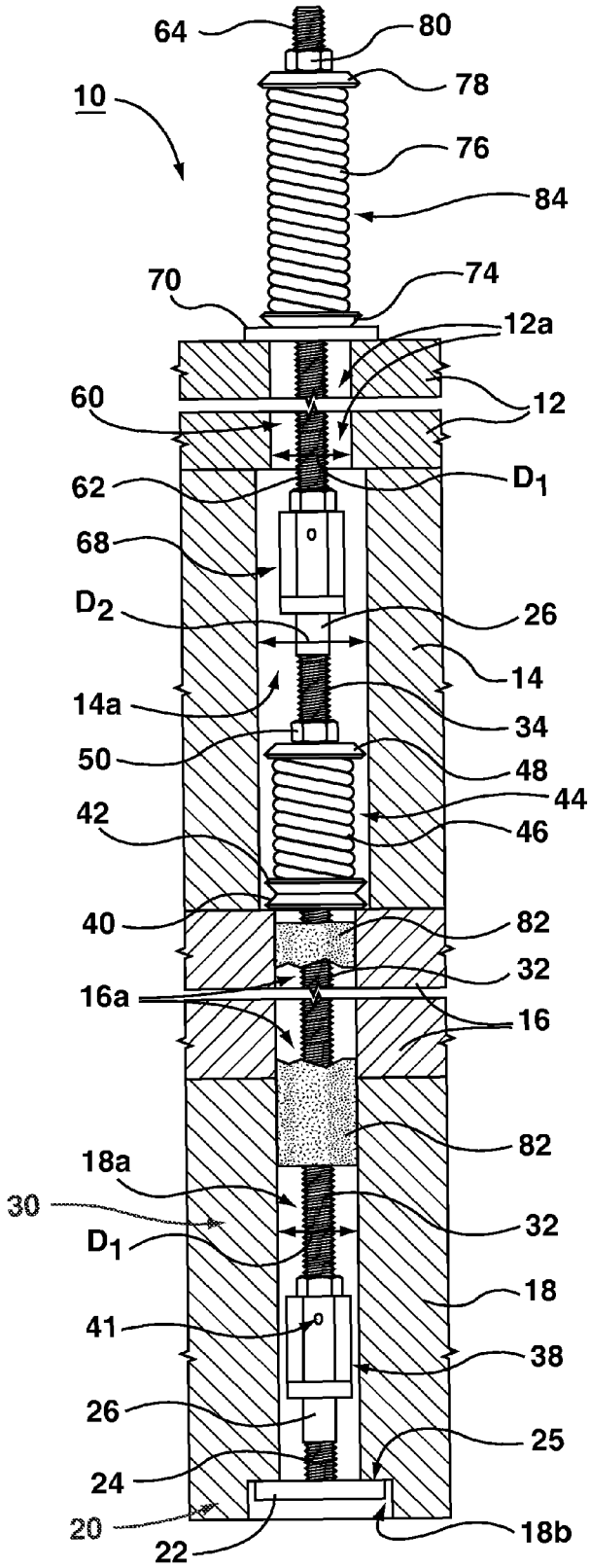
FIG. 2 is a cross-sectional elevation view of the apparatus and wall shown in FIG. 1.

As shown in FIGS. 1 and 2, a plurality of horizontally oriented timber members 12, 14, 16, 18 or other wall members are stacked one above the other to create a vertically extending wall. Each timber member 12, 14, 16, 18 has a through bore 12*a*, 14*a*, 16*a*, 18*a*, respectively, that passes from the top to the bottom of each timber member 12, 14, 16, 18. As shown in FIG. 2, the bores 12*a*, 14*a*, 16*a*, 18*a* are vertically aligned with each other and define a passageway through the entire wall that is sized and shaped to receive at least a portion of the apparatus 10 therein.

Generally, the apparatus 10 includes a base portion 20 configured to engage with a surface of a first timber member (e.g. the lowermost timber member 18), a first securing member 44 configured to engage with a surface of another timber member (e.g. timber member 16), and a first coupling member 30 configured to extend through the bores 16*a*, 18*a* of the timber members 16, 18 to couple the base portion 20 to the first securing member 44 for biasing the timber members 16, 18 together.

In some embodiments, the apparatus 10 may also include a second securing member 84 for engaging with another surface on yet another timber member (e.g. timber member 12) and a second coupling member 60 configured to extend through the bores 12*a*, 14*a* to couple the first coupling member 30 to the second securing member 84.

In some embodiments, the apparatus 10 may include additional securing members and coupling members. This may be useful to achieve a desired length of the apparatus 10 to accommodate walls of various heights.

Figure 4:
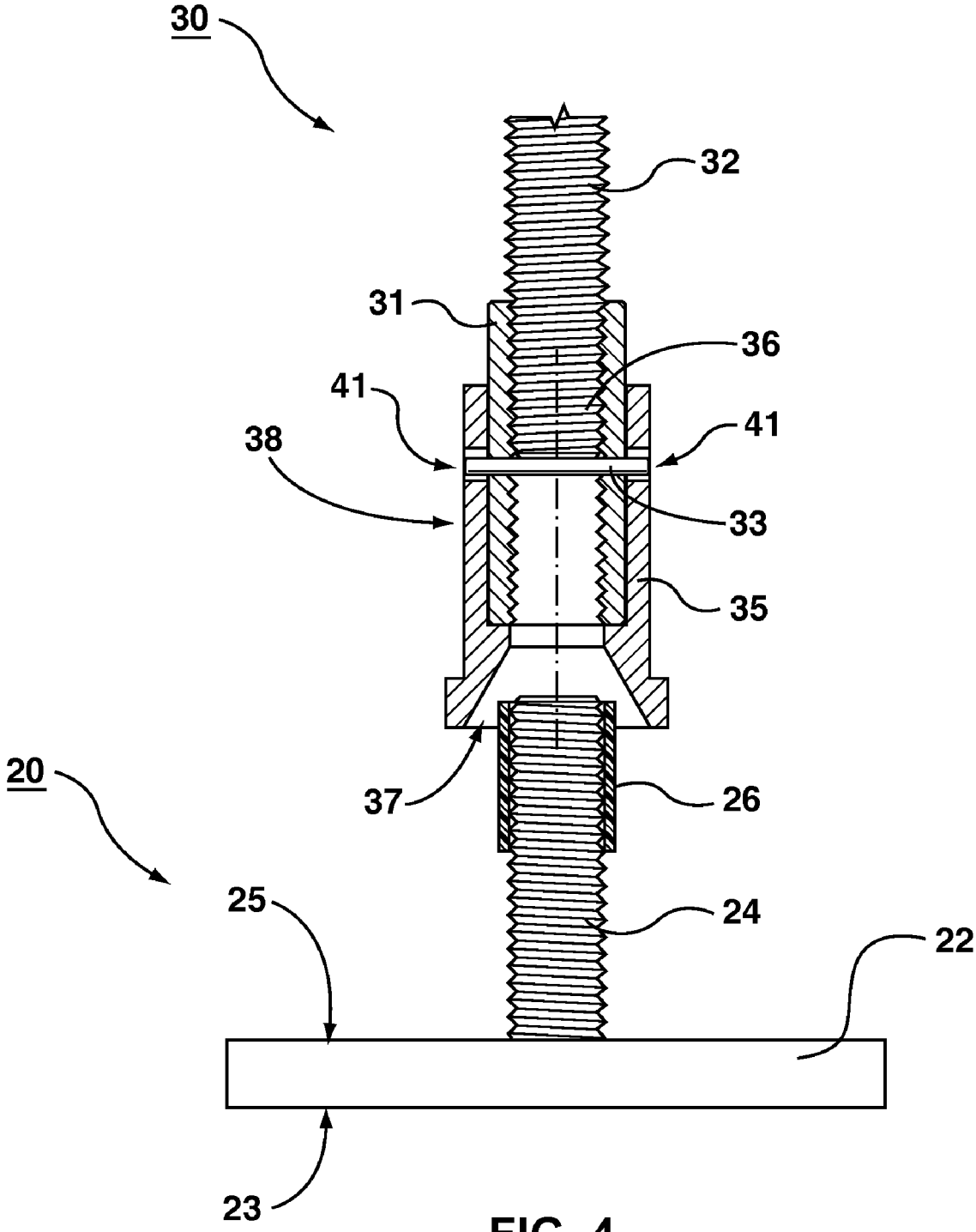
FIG. 4 is a close-up cross sectional view of the lower portion of the apparatus of FIG. 1.

Turning now specifically to the base portion 20, as shown in FIG. 4 the base portion 20 may include a base plate 22 having a lower surface 23 and an upper surface 25. The base portion 20 also includes a stud 24 that extends upwardly from the upper surface 25 of the base plate 22. As shown, in some embodiments at least a portion of the stud 24 may be externally-threaded.

The upper surface 25 of the base plate 22 is configured to be engaged against a lower surface of the lowermost timber member 18*a* (as shown in FIG. 2). In particular, the lowermost timber member 18 may have an enlarged bore 18*b* that is large enough to receive the base plate 22 therein. In turn, the base plate 22 may be larger than the through bore 18*a* of the timber member 18 such that the upper surface 25 of the base plate 22 can be engaged against the lower surface of the timber member 18 within the enlarged bore 18*b*.

In some embodiments, the base portion 20 may engage directly against a bottom surface of the lowermost timber member 18 (e.g. the upper surface 25 of the base plate 22 may bear directly against the lower surface of the timber member 18). In other embodiments, the base portion 20 may indirectly engage against a bottom surface of the lowermost timber member 18 (e.g. the base plate 22 may be provided below a floor surface or other ground surface, which in turns bears against the bottom surface of the timber member 18).

As shown in FIG. 2, in some embodiments, the base plate 22 has a thickness that is less than the height of the enlarged bore 18*a*. This may be desirable to inhibit the base plate 22 from interfering with the contact between the lowermost timber member 18 and a ground surface.

In the illustrated embodiment, the base plate 22 has a square shape. However, in other embodiments the base plate 22 may be round, hexagonal, or may have other suitable shapes.

As shown, in some embodiments a sleeve 26 may be provided on the upper end of the stud 24. The sleeve 26 tends to protect the threads of the stud 24, and can inhibit wood chips, sap, dirt and other debris from contacting the threads of the upper portion of the stud 24, which could lead to fouling of the stud 24 and inhibit coupling between the base portion 20 and the coupling member 30.

In some embodiments, the sleeve 26 is sized and shaped so that as the sleeve member 26 is received within the coupling member 30, the coupling member 30 will push the sleeve 26 down the stud 24 (e.g. towards the base plate 22). In particular, the sleeve 26 may cover less than the whole length of the stud 24 so that some movement of the sleeve 26 along the stud 24 is possible. This movement may tend to further clean any chips or other debris off of the threads on the stud 24.

In some embodiments, the sleeve 26 can be made of plastic, rubber, cloth, paper, metal, or other suitable materials.

In some embodiments, the sleeve 26 may be sized and shaped so that it may be received within the coupling member 30 as opposed to being pushed down the stud 24. For example, the sleeve 26 may be received between the threads on the stud 24 and the coupling member 30, and may in fact be consumed by the threads during coupling (e.g. where the sleeve 26 is made of a thin plastic or rubber).

Generally, if undesirable dirt or debris is located in the bore 18*a* on the stud 24 or sleeve 26, this debris may be cleaned by inserting a brush or other member into the bore 18*a* to wipe the debris off the stud 24 and the sleeve 26. In contrast, attempting such a cleaning technique with an internally threaded bottom coupler could be very difficult, and could lead to further fouling of the internally threaded bottom coupler.

Figure 3:
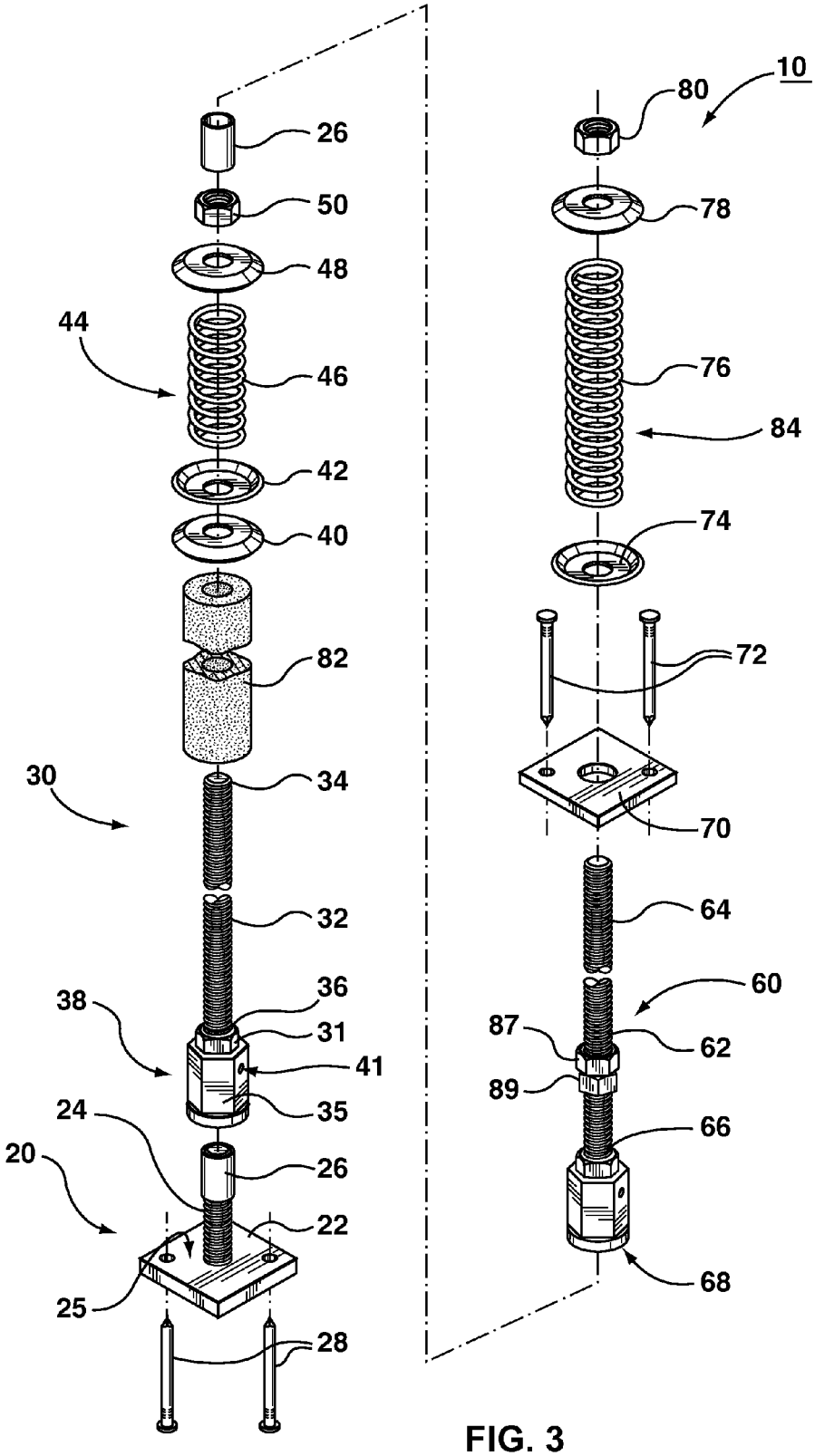
FIG. 3 is an exploded perspective view of the apparatus of FIG. 1.

As shown in FIGS. 1 and 3, in some embodiments nails 28 or other fasteners may be used to help secure the base portion 20 to the bottom surface of the lowermost timber member 18.

Turning now to the coupling member 30, as shown in FIGS. 3 and 4 the coupling member 30 includes an elongate rod member 32 having an upper end 34 and a lower end 36. The rod member 32 generally has a length selected to allow the base portion 20 to be secured to the securing portion 44 when in use and which may depend on the size of the timber members 16, 18. In some cases, the length of the rod member 32 may be pre-selected. In other embodiments, the rod member 32 can be cut as needed to achieve a desired length (e.g. as the wall is being created). At least the upper and lower ends 34, 36 of the rod member 32 are externally threaded, although in some embodiments the entire elongate rod member 32 may be threaded, as shown.

The coupling member 30 also includes a coupler indicated generally as 38. The coupler 38 is provided on the lower end 36 of the rod member 32 and is sized and shaped to receive the stud 24 therein.

The coupler 38 is shown in detail in FIG. 4. Generally, the coupler 38 may include an internally threaded nut member 31 that is configured to be received on the external threads of the lower end 36 of the rod member 32. The internal threads of the nut member 31 are also configured for threaded engagement with the externally-threaded portion of the stud 24 of the base portion 20 to secure the stud member 24 within the coupler 38.

In some embodiments, the nut member 31 may be secured to the lower end 36 of the rod member 32 using a roll pin 33 that is received in a cross-bore 41 in the nut member 31. The nut member 31 may be tightened onto the rod member 32, causing the roll pin 31 to engage the lower end 36 and deflect, thus binding the nut member 31 to the rod member 32. The roll pin 33 tends to inhibit the nut member 31 and the rod member 32 from decoupling during use.

In other embodiments, the nut member 31 may be secured to the rod member 32 using other techniques, such as by welding, using adhesives, etc.

As shown in FIG. 4, the coupler 38 may also have an outer member 35 that at least partially covers the nut member 31. As shown, a portion of the nut member 31 may be exposed above the outer member 35 to accommodate a wrench (e.g. for turning the nut member 31).

The outer member 35 may help protect the nut member 31, and may inhibit chips, dirt and other debris from entering the internally threaded portion of the nut member 31. Furthermore, the outer member 35 may also have a tapered opening 37 that may help to guide the nut member 31 to engage with the stud 24 when the coupling member 30 is being secured to the base portion 20 and the stud member 24 is being received within the coupler 38. Furthermore, the tapered opening 37 may also help to push the sleeve 26 down the stud 24 as the coupling member 30 and base portion 20 are coupled together.

In some embodiments, the outer member 35 may be made of a plastic, such as a polypropylene, or another suitable material.

As shown the apparatus 10 also includes a securing member 44 configured to be coupled to the coupling member 30 and to engage with a surface of another timber member (e.g. timber member 16) for biasing the timber members 16, 18 together. For example, the securing member 44 may include a first engaging member 40 that at least partially surrounds the rod member 32 and which is configured to engage an upper surface of the timber member 16.

In particular, as shown in FIG. 2, the bores 16*a*, 18*b* of the two lowermost timber members 16, 18 have a first diameter $D_1$. The first diameter $D_1$ is smaller than the diameter of the first engaging member 40 so that the engaging member 40 can be used to apply a compression force against the upper surface of the timber 16.

As shown, the engaging member 40 could be a downwardly-facing cup washer, with the flared outer edge of the cup washer engaging the upper surface of the timber member 16.

In some embodiments, the first diameter $D_1$ may be between about 2 inches and 1 inch. In some embodiments, the first diameter $D_1$ may be about 1.5 inches.

The securing member 44 may also include another pair of engaging members 42, 48 that cooperate to secure a spring member 46 therebetween generally on the rod member 32 of the coupling member 30. As shown, the engaging members 42, 48 may also be cup washers, with the engaging member 42 facing upwardly and the engaging member 48 facing downwardly.

In some embodiments, a guide sleeve (not shown) may be provided between the spring member 46 and the rod member 32 to further guide the spring member 46 and which may inhibit the spring member 46 from tilting or tipping.

As shown, a nut 50 may be threaded onto the upper end 34 of the rod member 32 to secure the securing member 44 to the coupling member 30. Generally, the nut 50 can be tightened to achieve a desired amount of compression between the timber members 16, 18 so as to bias the timber members 16, 18 together.

Furthermore, the nut 50 can be tightened so as to apply pre-compression to the spring member 46. The spring member 46 can thus be configured to accommodate expansion and contraction of the timber members 16, 18 (e.g. due to changes in moisture content of the timber members 16, 18) while applying a biasing force to inhibit the formation of undesired spaces or gaps therebetween.

Depending on the sizes of the timber members 16, 18, the spring member 46 may generally be of various shapes and sizes to provide a desired biasing force. For example, in some embodiments, the spring member 46 may be a 950 psi compression spring with 0.75 inches of travel. In other embodiments, larger or smaller springs may be used.

Optionally, the upper end 34 of the rod 32 may also include a sleeve 26, which may be used to protect the threads of the upper end 34 (e.g. during installation of the apparatus 10 or transportation to a worksite). In some embodiments, the sleeve 26 may be movable along the upper end 34 of the rod 32 as the upper end 34 is received in the coupler 68, as described below.

As shown, the third timber member 14 above the timber members 16, 18 has a through bore 14*a* with a second diameter $D_2$. The second diameter $D_2$ is larger than the first diameter $D_1$ and is generally large enough to receive the engaging members 40, 42, 48 and the spring member 46 therein. In particular, the second diameter $D_2$ should be at least as large as the diameter of the engaging member 40. Accordingly, the engaging member 40 can be received in the bore 14*a* and engaged against an upper surface of the timber member 16.

In some embodiments, the second diameter $D_2$ may be between 1.5 inches and 2.5 inches. In some embodiments, the second diameter $D_2$ may be about 2 inches.

In some embodiments, this larger second diameter $D_2$ may be useful to allow a heavier timber member (e.g. timber member 14) to be installed onto the wall after the lower coupling member 30, securing member 44 and base portion 20 have been installed on the lower timber members 16, 18. The larger second diameter $D_2$ may facilitate alignment between the bore 14*a* and the securing member 44.

In some embodiments, the engaging member 40 may be sized and shaped to engage against another surface of the timber member 16. For example, the engaging member 40 may be received within a countersunk bore in the timber member 16 and may engage against a surface within the countersunk bore.

As discussed above, the apparatus 10 may also include a second securing member 84 for engaging with another upper surface on the timber member 12, and a second coupling member 60 configured to extend through the bores 12*a*, 14*a* to couple the first coupling member 30 to the second securing member 84. Generally, the second securing member 84 and second coupling member 60 may be used to bias other timber members together (e.g. timber members 12, 14) to inhibit the formation of undesired spaces or gaps therebetween.

The coupling member 60 may be the same as or generally similar to the coupling member 30, and may include a rod member 62 having threaded upper and lower ends 64, 66, with a coupler 68 connected to the lower end 66. Generally, the coupler 68 may be the same as or similar to the coupler 38 as described above.

The securing member 84 may also be the same as or similar to the securing member 44 as described above, and may include a spring member 76 received between two members 74, 78 (e.g. cup washers). The securing member 84 also includes an upper plate member 70 that can be received on the upper surface of the timber member 12.

A top nut 80 may be used to secure the securing member 84 onto the coupling member 60 and can be tightened so that the upper plate member 70 applies a desired amount of compression between the timber members 12, 14 so as to bias the timber members 12, 14 together, or at least to bias the timber member 12 towards the timber members 16, 18.

Furthermore, the nut 80 can be tightened so as to apply pre-compression to the spring member 76. The spring member 76 can thus be configured to accommodate expansion and contraction of the timber members 12, 14 (e.g. due to changes in moisture content of the timber members 16, 18) while inhibiting the formation of undesired spaces or gaps therebetween.

The spring member 76 may generally be of various shapes and sizes to provide a desired biasing force. For example, in some embodiments, the spring member 76 may be a 1000 psi spring with 1.5 inches of travel. In other embodiments, larger or smaller springs may be suitable.

In some embodiments, nails 72 or other fasteners may be used to help secure the upper plate member 70 to the upper surface of the timber member 12.

In the illustrated embodiment, the upper plate member 70 has a square shape. However, in other embodiments the upper plate member 70 may be round, hexagonal, or may have other suitable shapes.

Generally, the use of a plurality of securing members (e.g. securing members 44, 84) and coupling members (e.g. coupling members 30, 60) may inhibit the formation of undesired gaps between the timber members 12, 14, 16, 18. Furthermore, since a plurality of securing members and coupling members may be secured together, walls with various different heights may be accommodated.

Furthermore, the use of a plurality of securing members and coupling members may tend to assist in inhibiting bowing or distortion of the wall. Normally, a log wall consists of a plurality of timber members laid horizontally and stacked to a desired height. However, stability and alignment of the wall tend to be problematic, both during and after construction. In particular, as a wall gets higher and higher, it tends to become less stable.

Furthermore, tall walls have a tendency to bow or distort. This may be due to the loads placed on the walls (and may in fact be further aggravated by over-tightening a traditional through-bolt assembly), or due to the drying and settling of the timber members.

However, dividing a vertical wall into two or more shorter wall sections (using the securing members and coupling members as generally described herein provided within the wall) can reduce the lateral deflection of the wall as well as increase overall rigidity and reduce the impact of lateral forces (e.g. due to high winds, etc.) on the wall.

In some embodiments, the apparatus 10 may include one or more protection members 82. The protection member 82 may be received within one or more of the bores 12*a*, 14*a*, 16*a*, 18*a*, and may act as an insulating sleeve that covers at least some of the apparatus. The protection member 82 may inhibit oxidization, rust, etc. of the components of the apparatus 10 due to moisture content. In some embodiments, a plurality of protection members 82 can be provided within the bores 12*a*, 14*a*, 16*a*, 18*a*.

The protection member 82 may be made of any suitable material, such as a flexible material, a foam material (and which may be compressible). The protection member 82 may have various lengths and shapes. In some embodiments, the protection member 82 may be sized so as to be securely received in the bores 12*a*, 14*a*, 16*a*, 18*a* and to encapsulate at least a portion of the components of the apparatus 10 therein.

In some embodiments, the protection member 82 may be at least partially split so that it may be placed around the various components of the apparatus 10.

In some embodiments, the apparatus 10 may also include one or more nuts 87, 89 provided on one or more of the rod members 32, 62, as shown in FIG. 3. Generally, the nuts 87, 89 may be used as guides for cutting the rod members 32, 62 to a desired length.

The nuts 87, 89 may also be used to facilitate securing the coupler 68 to the rod member 62. In particular, the nuts 87, 89 may be tightened against the coupler 68 to help inhibit the coupler 68 from becoming disengaged from the rod member 62.

Nuts 87, 89 may also add additional weight to the coupling member 60. This may be beneficial when inserting the coupling member 60 into the bores 12*a*, 14*a*, 16*a*, 18*a* as it may help to align the coupling member 60 vertically therein.

In some embodiments, the base portion 20 may be a ground surface (e.g. a concrete floor) and the externally-threaded stud 24 may be embedded directly in the floor and extend upwardly therefrom.

While the embodiments described herein may refer to various directional qualifiers such as height, length, width, sideways, upper, lower, bottom, top, horizontal or vertical, these directions are merely for illustrative purposes and are not intended to limit the scope of the invention. In some embodiments, the various elements may be oriented in different directions.

What has been described is merely illustrative of the application of the principles of the embodiments. Other arrangements and methods can be implemented by those skilled in the art without departing from the spirit and scope of the embodiments described herein.

The invention claimed is:

1. An apparatus for securing a plurality of wall members together to define a log wall, the apparatus comprising:

(a) a base portion having a stud extending upwardly therefrom, the base portion being configured to engage a surface of a first wall member;

(b) a first securing member sized and shaped to engage with a surface of a second wall member stacked above the first wall member; and (c) a first coupling member configured to extend through a bore in the first and second wall members, the first coupling member having:

(i) an elongate rod member having an upper end and a lower end; and (ii) a coupler fixedly secured on the lower end of the rod member before the first coupling member is inserted into the bore, the coupler being sized and shaped to fit into the bore and to receive the stud therein to couple the stud to the rod member;

(d) wherein the upper end of the rod member is configured to be coupled to the first securing member for biasing the first and second wall members together.

2. The apparatus of claim 1, wherein the stud has an externally-threaded portion, and the coupler has an internally threaded portion configured to engage with the externally-threaded portion of the stud as the stud is received within the coupler.

3. The apparatus of claim 2, wherein the coupler comprises a nut member having the internally threaded portion and a cross-bore, and a roll pin shaped to be received in the cross-bore.

4. The apparatus of claim 3, wherein the coupler also comprises an outer member shaped to be received on the nut member, the outer member having a cross-bore located to register with the cross-bore on the nut member and sized to receive the roll pin.

5. The apparatus of claim 4, wherein the outer member has a tapered bottom opening shaped to guide the nut member to engage with the stud.

6. The apparatus of claim 1, further comprising a second securing member sized and shaped to engage with a surface of a third wall member, and a second coupling member having a second coupler sized and shaped to receive the upper end of the rod member therein.

7. The apparatus of claim 6, wherein the upper end of the rod member is externally threaded, and wherein the second coupler has an internally threaded portion configured to engage with the external threads of the upper end of the rod member.

8. The apparatus of claim 1, wherein the first securing member includes a spring member sized and shaped to accommodate expansion and contraction of the first and second wall members.

9. The apparatus of claim 1, wherein the second wall member has a bore with a first diameter, and the securing member includes an engaging member larger than the bore, the engaging member shaped to engage against the surface of the second wall member.

10. The apparatus of claim 1, further comprising at least one protection member sized and shaped to be received in the at least one bore, wherein the protection member is made from a flexible and compressible foam material.

11. An apparatus for securing a plurality of wall members together to define a wall, the apparatus comprising:

(a) a base portion having a stud extending upwardly therefrom, the base portion being configured to engage a surface of a first wall member;

(b) a first securing member sized and shaped to engage with a surface of a second wall member stacked above the first wall member; and (c) a first coupling member configured to extend through a bore in the first and second wall members, the first coupling member having:

(i) an elongate rod member having an upper end and a lower end; and (ii) a coupler on the lower end of the rod member, the coupler being sized and shaped to receive the stud therein to couple the stud to the rod member;

(d) wherein the upper end of the rod member is configured to be coupled to the first securing member for biasing the first and second wall members together;

(e) further comprising a sleeve member sized and shaped to cover at least a portion of the externally-threaded portion of the stud member.

12. The apparatus of claim 11, wherein the sleeve member is sized and shaped so as to be pushed down the stud as the stud is received in the coupler.

13. A log wall comprising:

(a) a first wall member;

(b) a second wall member stacked above the first wall member; and (c) an apparatus for securing the wall members together, comprising:

(i) a base portion having a stud extending upwardly therefrom, the base portion configured to engage a surface of the first wall member;

(ii) a first securing member sized and shaped to engage with a surface of the second wall member; and (iii) a first coupling member configured to extend through a bore in the first and second wall members, the first coupling member having: an elongate rod member having an upper end and a lower end, and a coupler fixedly secured on the lower end of the rod member before the first coupling member is inserted through the bore, the coupler being sized and shaped to fit through the bore and to receive the stud therein to couple the stud to the rod member;

(iv) wherein the upper end of the rod member is configured to be coupled to the first securing member for biasing the first and second wall members together.

14. The wall of claim 13, wherein the stud has an externally-threaded portion, and the coupler has an internally threaded portion configured to engage with the externally-threaded portion of the stud as the stud is received within the coupler.

15. The wall of claim 14, wherein the apparatus further comprises a sleeve member sized and shaped to cover at least a portion of the externally-threaded portion of the stud member.

16. The wall of claim 15, wherein the sleeve member is sized and shaped so as to be pushed down the stud as the stud is received in the coupler.

17. The wall of claim 13, further comprising a third wall member stacked above the second wall member, and wherein the apparatus further comprises a second securing member sized and shaped to engage with a surface of the third wall member, and a second coupling member having a second coupler sized and shaped to receive the upper end of the rod member therein.

18. The wall of claim 17, wherein the upper end of the rod member is externally threaded, and wherein the second coupler has an internally threaded portion configured to engage with the external threads of the upper end of the rod member.

19. The wall of claim 13, wherein the first securing member includes a spring member sized and shaped to accommodate expansion and contraction of the first and second wall members.

20. The wall of claim 13, wherein the second wall member has a bore with a first diameter, and the securing member includes an engaging member larger than the bore, the engaging member shaped to engage against the surface of the second wall member.

21. The wall of claim 13, further comprising at least one protection member sized and shaped to be received in the at least one bore.

22. A log wall, comprising:

(a) a first wall member;

(b) a second wall member stacked above the first wall member;

(c) a third wall member stacked above the second wall member; and (d) an apparatus for securing the wall members together, comprising:

(i) a base portion configured to engage a surface of the first wall member;

(ii) a first securing member provided within the wall and being sized and shaped to engage with a surface of the second wall member wherein the first securing member includes a spring member sized and shaped to accommodate expansion and contraction of the first and second wall members;

(iii) a first coupling member configured to extend through a bore in the first and second wall members to couple the base portion to the first securing member;

(iv) a second securing member sized and shaped to engage with a surface of the third wall member wherein the second securing member includes a spring member sized and shaped to accommodate expansion and contraction of the second and third wall members; and (v) a second coupling member configured to extend through a bore in the third wall member to couple the first coupling member to the second securing member.

23. The wall of claim 22, wherein the first spring member and the second spring member are compression springs.

* * * * *